United States Patent [19]

Campbell et al.

[11] Patent Number: 4,496,440

[45] Date of Patent: Jan. 29, 1985

[54] OXIDATION OF HYDROPHOBIC —$CH_2OH$ COMPOUNDS AT OXIDIZED NICKEL ANODES

[75] Inventors: Kent D. Campbell, Concord; Aylin H. Gulbenkian, Walnut Creek; Fred Y. Edamura, Concord, all of Calif.; Demetrios Kyriacou, Salonica, Greece

[73] Assignee: The Dow Chemical Company, Midland, Mich.

[21] Appl. No.: 617,063

[22] Filed: Jun. 4, 1984

[51] Int. Cl.[3] ..... C25B 3/02

[52] U.S. Cl. ..... 204/78

[58] Field of Search ..... 204/78

[56] References Cited

U.S. PATENT DOCUMENTS 4,203,811 5/1980 Cramer ..... 204/78

*Primary Examiner*—R. L. Andrews

*Attorney, Agent, or Firm*—Robert R. Stringham

[57] ABSTRACT

Mono- or dimethylol compounds having water solubilities of 3 grams or less per 100 grams of water are electrochemically oxidized to the corresponding mono- or dicarboxylic acids at activated nickel oxide anodes. The methylol compounds are adducts of 1,2-alkylene oxides with phenols, pyridinols, bisphenols, phenoxy- or pyridinyloxypyridinols or are polycycloaliphatics ring-substituted with one or two $CH_2OH$ groups.

14 Claims, No Drawings

OXIDATION OF HYDROPHOBIC —$CH_2OH$ COMPOUNDS AT OXIDIZED NICKEL ANODES

BACKGROUND OF THE INVENTION

Oxidation of a variety of primary and secondary alcohols at oxidized nickel anodes is well known. The variety includes aralkanols and aralkenols; alkanols, alkenols and alkynols; furfuryl alcohol and diacetone-L-sorbose; cycloalkanols; cycloalkenols and bicycloalkanols; hydroxy steroids and polyalkyleneglycols. Depending on whether the alcohol is a primary or secondary alcohol and on the nature of the rest of the substrate molecule, the reaction products generally are aldehydes and/or acids or are ketones. The aralkanols which have been oxidized include species having alkyl, methoxy, nitro or chloro substitutents on the aromatic ring.

So far as is known to the present Applicants, the anodic oxidation of hydrophobic compounds comprising methylol groups attached directly to polycycloaliphatic or heteroaromatic nuclei or, through alkoxy links, to aromatic or heteroaromatic rings has not been contemplated in the prior art.

OBJECTS OF THE INVENTION

Broadly, the object of the present invention is to provide an electrochemical method for converting certain hydrophobic types of methylol compounds to the corresponding carboxylic acids.

A particular object is to provide such a method which avoids the co-production of dioxins in the manufacture of certain phenoxy-type herbicides and pesticides.

Another particular object is to provide such a method which facilitates utilization of polycycloaliphatic diols as precursors to diacids having utility for the manufacture of polyesters having outstanding physical properties.

A further object is to provide such a method by which the desired oxidation can be accomplished without substantial concurrent degradation of the substrate molecule to which the methylol group(s) is (are) attached.

Still other objects will be made apparent to those knowledgeable in the art by the following specifications and claims.

SUMMARY OF THE INVENTION

The present invention is the method of oxidizing a —$CH_2OH$ group in a hydrophobe to a —CHO or —COOH group which comprises electrochemically oxidizing said hydrophobe, in a basic aqueous medium, at an oxidized nickel anode, said hydrophobe being selected from the group consisting of:

(A) glycol ethers of the formula $$R^1\left(O-\underset{}{\overset{R}{\overset{|}{C}H}}-CH_2OH\right)_x \qquad (I)$$

wherein x=1 or 2,

R=H or a $C_1$–$C_{40}$ hydrocarbyl or heterohydrocarbyl radical, optionally substituted with one or more non-interfering radicals, $R^1$ is a mono- or divalent radical of one of the following formulas a, b or c

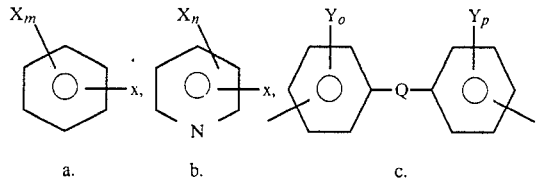

a. b. c.

wherein x is 1 or 2,

X is halo, haloalkyl, alkyl, alkenyl, amino, nitro, alkoxy or haloalkoxy, independently in each occurrence, m is 0 to 5 and n, o and p are each, independently, 0–4, Q is a valence bond, a $C_1$–$C_4$ alkylene or alkenylene group, $>C(CF_3)_2$, —CO—, —S—, —$SO_2$— or —O—; and Y is halo, alkyl, alkenyl alkoxy, haloalkoxy or nitro, independently in each occurrence, with the provisos that:

the maximum number of nitro groups per ring is 3 in formula a and 2 in formulas b and c;

the maximum number of alkyl, alkenyl, alkoxy and/or haloalkoxy groups per ring is 2 in formulas a and b and 1 in formula c;

the maximum number of amino groups per ring, in formulas a and b, is 2; and the maximum number of haloalkyl groups per ring, in formulas a and b, is 2;

(B) phenoxyaryl- or phenoxyheteroaryloxyethanols of the formula

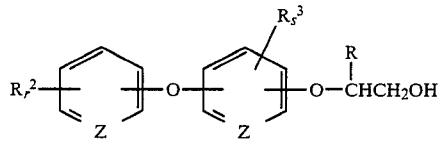

(II)

wherein r=0, 1, 2, 3 or 4 and s=0, 1, 2 or 3,

Z=CH or N, in one occurrence and N in the other, $R^2$, independently in each occurrence, is alkyl, alkenyl, haloalkyl, halo, nitro, amino, $C_2$–$C_{42}$ alkoxy or haloalkoxy or is $OCHRCH_2OH$, R is as defined with regard to formula I;

$R^3$, independently in each occurrence, is alkyl, alkenyl, haloalkyl, halo, nitro, amino, alkoxy or haloalkoxy;

with the provisos that:

not more than one $R^2$ or $R^3$ group per ring is nitro, not more than two $R^2$ or $R^3$ groups per ring are haloalkyl, not more than one $R^2$ or $R^3$ group per ring is amino, not more than one $R^2$ or $R^3$ group per ring is alkoxy or haloalkoxy, not more than one $R^2$ is O—$CHRCH_2OH$, not more than one $R^2$ or $R^3$ group per ring is alkyl or alkenyl; and (C) polycycloaliphatics ring-substituted by one or two $CH_2OH$ groups and, optionally, with one or more non-interfering radicals.

Aldehydes presumably are produced as intermediate species in the course of converting the methylol groups to carboxyl groups by the present process. Presumably, with less readily oxidized substrates and/or the use of less active anodes—such as nickel which has been activated at lower potentials—aldehydes can be obtained as end products. In general, however, the oxidation of aldehydes to acids appears to proceed so readily under the oxidation conditions employed that detection and recovery of aldehydes is difficult.

DEFINITIONS OF TERMS

As used herein, the meanings of certain of the terms in the preceding Summary are as follows:

"Hydrophobe"

A compound which has a low to negligible solubility in water; on the order of 3 grams per 100 grams of water, or less.

"Basic, Aqueous Medium"

A mixture or solution in which the hydrophobic substrate to be oxidized can be dissolved or dispersed and which comprises both water and hydroxyl ions.

"Oxidized Nickel Anode"

An anodically polarized electrode having an oxidized nickel surface layer capable of oxidizing —$CH_2OH$ groups at least to —CHO groups.

"Electrochemical Oxidation"

An oxidation which takes place at the anodically polarized electrode in an electrochemical cell; the reaction is believed to be electrocatalytic in nature but the invention is not predicated on the correctness of this belief.

"Halo"

Fluoro, chloro or bromo.

"Haloalkyl"

Alkyl substituted with from one to several halo radicals; trifluoromethyl, for example.

"Polycycloaliphatics"

Cyclic compounds comprising two or more rings of which at least one is aliphatic and has at least two ring carbons in common with another of said rings.

"Non-interfering Radical"

Any substituent which does not detrimentally affect the oxidation, or recovery of the desired oxidation product(s), to an intolerable extent.

DETAILED DESCRIPTION

Suitable Methylol Substrates

In addition to the phenoxy- and pyridinyloxyethanols employed as substrates in Examples 1–3 and 5, a wide variety of other —$CH_2OH$ compounds of the formula I given earlier herein are suitable for the practice of the present invention. The latter include adducts of 1,2-alkylene oxides in general with phenols and pyridinols in general.

Exemplary phenols for the preparation of such adducts are phenol itself, o, m and p-dihydroxy benzenes; o, m and p-cresols, thymol, carvacrol, isopropenyl phenols, anol, o-allyl phenol, vinyl phenols, 2,4,6-tribromophenol, nitrophenols, mono- and dichlorophenols, mono-aminophenols, 2-amino-4-chloro-5-nitrophenol, 5-chloro-2-nitrophenol, 2,5-diaminophenol, guaicol and 2-butoxyphenol, diethyl phenol, bisphenol A, picric acid; etc.

Exemplary pyridinols for adduct preparations include 2,4- and 2,6-dihydroxy pyridine, the monohydroxypyridines, halo- and alkyl- and nitro-substituted pyridinols, as disclosed in U.S. Pat. No. 3,335,146; mono-halopyridinols, disclosed in U.S. Pat. No. 3,355,456; polyhalo-4-pyridinols, disclosed in U.S. Pat. No. 3,249,419; 3,5-dihalo-2,6-di(lower alkyl)-4-pyridinols, disclosed in U.S. Pat. No. 3,206,358; 3,5-dibromo- or dichloro-6-fluoro-2-pyridinol, difluoroaminopyridinols, disclosed in U.S. Pat. No. 3,317,542; base-hydrolysis products of polyhalo-nitropyridines, the latter disclosed in British Pat. No. 1,038,530; mono- and dihalo-3-hydroxypyridines, disclosed in British Pat. No. 1,058,457; bis(trifluoromethyl)-2-pyridinols, optionally substituted with one or two halo (Br and/or Cl) radicals, disclosed in U.S. Pat. No. 3,682,938, etc.

The preferred substrates of the foregoing types are adducts of 1 molecule of ethylene- or propyleneoxide per "phenolic" hydroxyl on the phenol or pyridine. However, adducts derived from higher (up to $C_{42}$) 1,2-alkylene oxides, including 1,2-octylene oxide, limonene monoxide, styrene oxide, and glycidyl benzene, etc., are considered suitable, so long as at least some of the resulting adduct molecules have the hydroxyl on an end carbon of the 1,2-oxide molecule, i.e., the hydroxyls are found in —$CH_2OH$ groups. The alkylene oxide molecule of course may include such substituents as do not seriously interfere with the adduction (or the oxidizeability of the adduct (substrate).

Among the foregoing preferred adducts, those of formula I herein in which the phenol or pyridinol is monohydric and is substituted with two to three chlorines and/or fluorines and —optionally—an amino group are a preferred sub-group. The di-adducts of bisphenols with ethylene and propylene oxide constitute another more preferred sub-class of substrates. Most preferred among the adducts of formula I are those employed as substrates in Examples 1–3 and 5 herein.

Suitable phenoxy and pyridinyloxy pyridines of formula II include adducts of 1,2-alkylene oxides—represented by those mentioned above with regard to formula I adducts—with compounds of the formulas

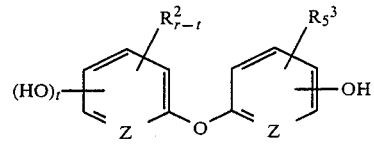

(III)

wherein t is 0 or 1, Z, r, s and $R^3$ are as defined above for formula II and $R^2$ is also as defined above except that it may not be —O—CHR—$CH_2OH$.

It will be recognized that the compounds of formula III are aromatic ethers, which can be made by a variety of methods, utilizing the known chemistry of substituted and unsubstituted, mono- and dihydric phenols and pyridinols. Those knowledgeable in the art will recognize that the synthetic route to be used when a 2-pyridinol group is to be etherified should be chosen with the tendency for N-alkylation to compete with O alkylation (due to tautomerism) in mind. Since at least one of the two rings joined by the ether link must eventually have a free hydroxyl attached to it in the formula III intermediate, the latter hydroxyl must be "present"

in the starting phenol or pyridinol as such or as a radical—such as a readily hydrolyzed halo radical or an acetoxy or methoxy group—which can be readily converted to the desired hydroxyl.

Thus, for example, an appropriately substituted 2-halopyridine can be reacted with a methoxy-substituted pyridinol in an appropriate solvent (dimethyl sulfoxide, for example) with a base, such as $K_2CO_3$, to form a methoxy-substituted, pyridinyloxy pyridine which can then be converted with HBr to the corresponding pyridinyloxypyridinol. It is also possible to react a halopyridinol with itself, when both the halo and hydroxy groups are sufficiently reactive under conditions not favorable to polymerization, and then to separate the desired pyridinyloxypyridinol from any oligomeric products. Alternatively, one of the two hydroxyls in a dihydric phenol will usually be more reactive with a halopyridine or pyridinol in the presence of an appropriate etherification reagent and the desired pyridinyloxyphenol can be separated from any bis-ethers formed. Similarly, a dihydric phenol may be etherified directly with a dihydric pyridinol and the desired hydroxyphenoxypyridinol isolated from the reaction mixture.

Such other substituents as are to be present in the formula III product can be present in the starting compounds or can be introduced, after the ether link has been established, by such well known reactions as reduction of nitro groups to amino groups, diazotization, halogenation, halogen exchange reactions, base hydrolysis, etc. Exemplary of starting materials in which the substituents are already present are those phenols and pyridinols listed above with regard to preparation of formula I adducts. The effects of the kinds, numbers and relative location on the rings of the various substituents, on the reactivities of halo and hydroxyl groups can be judged by those knowledgeable in the art according to known principles.

A preferred class of formula II substrates consists of those deriveable by the adduction of 1,2-alkylene oxides with the pyridinyloxy phenols of the following formula:

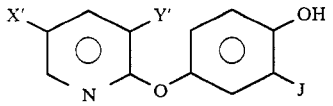

(IV)

wherein X' is $CF_3$ or halo, Y' is halo and J is H or chloro.

Among the latter preferred adducts, those deriveable from propylene oxide are particularly preferred.

Polycycloaliphatic methylol compounds suitable for the practice of the present invention include not only the dimethanols (norbornene dimethanol and dicyclopentadiene dimethanol) employed in Example 6 herein, but also include a variety of hydroformylation products of polycyclic olefins and diolefins. Exemplary such olefins are α- and β-pinene, 1,2,3,4,5,6,7,8-octahydrophenanthrene, ε-fenchene, α-fenchene, the Diels-Alder adducts of hexachlorocyclopentadiene with acetylene and of cyclopentadiene with acrylates; ethylidenenorbornene and of dicyclopentadiene (as a source of either the mono- or dihydroformylation products). Also included are hydrogenolysis products of polycyclic aldehydes, such as—for example—the Diels-Alder adducts of cyclopentadiene or dicyclopentadiene with acrolein, crotonaldehyde and other dienophilic aldehydes.

The polycycloaliphatic methylol compounds having two methylol groups constitute a preferred class. Those employed in Example 6 are particularly preferred.

Most preferred are those among the latter adducts deriveable from the following fourteen compounds of formula IV.

| X' | Y' | J |
|---|---|---|
| $CF_3$ | Cl | H or Cl |
| $CF_3$ | F | " |
| F | Cl | " |
| F | F | " |
| Cl | Cl | " |
| Br | Cl | " |
| Br | F | " |

Anode Activation

The oxidized nickel anode employed in the practice of the present invention may be prepared by several different electrodeposition methods, including a couple of novel such methods, not invented by the present Applicants. Of the latter methods, one is particularly preferred for carrying out the process claimed herein.

The electrode on which the oxidized nickel ("nickel peroxide" or NiO/NiO(OH), for example) is formed preferably consists of nickel. However, any other, adequately conductive material to which nickel hydroxide will adhere and which does not deleteriously effect the reaction to an intolerable extent may be employed as the underlying electrode material. Exemplary such other metals includes stainless steel or platinum.

The electrode support material chosen has been found to have an effect on current efficiencies, depending on the hydrophobicity of the substrate alcohol. Thus, when a porous nickel plaque was used, better results were obtained with the less hydrophobic alcohols. For alcohols which required higher proportions of t-butanol to water in the reaction mixture, better results were obtained using a "membrane electrode" pressed from nickel powder in a TEFLON*-graphite matrix.

(*registered trademark of E. I. duPont deNemours and Co.)

The activity of the anode toward alcohols is dependent on first building up a layer of nickel hydroxide ($\beta$-$Ni(OH)_2$, according to the literature), as by a low frequency sequence ("square wave") of polarity reversals while using a buffered 0.1M $NiSO_4$ electrolyte. The anode is then "charged" at a low anodic potential (0.5 to 0.65 volts vs. Ag/AgCl, for example) for about 30 to 60 minutes.

The so-called Kandler method of nickel peroxide electrodeposition is suitable for present purposes and is described by Kaulen and Shafer, "Oxidation of Primary Alcohols to Carboxylic Acids at the Nickel Hydroxide Electrode", *Synthesis Communications,* 513–516 (July 1979) (incorporated herein by reference). The electroplating is done by placing the anode and a suitable cathode in an electrolytic cell. The cell contains a solution comprising: a salt of the silver, cobalt, copper or nickel; an alkaline metal or alkaline earth metal acetate; and an alkaline metal or alkaline earth metal hydroxide, for example, 0.1N nickel sulfate, 0.1N sodium acetate and 0.005N sodium hydroxide. The polarities of the anode and cathode are reversed at intervals of about 0.25–10 seconds until a uniformly black layer of the nickel peroxide has formed on the anodic electrode, using a current density in the range of about 1–10 milliamps per $cm^2$. During this electrolysis, the potential differences should be high enough to plate nickel peroxide onto the anode but not so high as to electrolyze large amounts of water. A potential difference of 0.7 volts is generally adequate. Upon completion of the electrodeposition step, the cell is drained, rinsed with deionized water and charged with 2% aqueous NaOH. A sufficient potential difference is applied between the anode and cathode to establish an initial current density of about 30 $ma/cm^2$. The current density is then allowed to decay for about 20 to 30 minutes and the anode removed and rinsed with deionized water. The oxidized anode can be used immediately or stored, for a short time, in water which is free of reductants. The foregoing procedure is usually carried out at temperatures in the range of from about 10° to 30° C.

A more active anode results if the foregoing procedure is repeated in its entirety, at least once and preferably twice. (This improvement was not discovered or devised by the present Applicants.)

Anodes which are believed to be sufficiently active to be suitable at least for the oxidation of alcohols having water solubilities approaching 3 grams per 100 grams of water may be prepared by another, simpler procedure (which, again, was not discovered or devised by the present inventors). That is, an electrode consisting of nickel or having a nickel surface layer is immersed in an aqueous base (in which a suitable counter-electrode is also immersed) and is anodically polarized, thereby forming a thin coating of NiO(OH). The anode is then subjected to low frequency, galvanostatic cycling (a sequence of polarity reversals at essentially constant current) at a current density in excess of that corresponding to the active voltametric wave of the NiO(OH) half cell. Generally, current densities of from about 5 $ma/cm^2$ to about 100 $ma/cm^2$, preferably from about 25 to 75 $ma/cm^2$, are employed, depending—in a manner familiar to those knowledgeable in the art—on other factors, such as base concentration and the presence of solvents other than water. Generally, about 1–2 molar aqueous NaOH will be found quite suitable as the electrolyte for the oxidation ("activation") of the anode.

The polarity reversals may be at regular intervals of from about 1 to 20 seconds but preferably the anodic polarizations last from about 5 to 15 seconds and the cathodic polarizations (of the "anode" being activated) last from about 2 to about 5 seconds. Cycling is continued, desirably, for at least ten minutes—which results in an NiO/NiO(OH) layer thickness of about 60 monolayer equivalents. Preferably, cycling is continued for a time coulometrically calculated to be sufficient to provide a layer thickness of about 100 monolayer equivalents. (For commercial scale anodes, galvanic cycling may have to be continued for several hours, or even for days).

As a final step in the anode activation procedure, the anode may be subjected to anodic polarization (in the aqueous base) for a continuous period of from about 0.5 to 10 minutes, preferably about 2 to 5 minutes.

When the cycling is carried out at the above specified current densities, some evolution of oxygen, then hydrogen, then oxygen, etc., usually occurs at each electrode and precautions should be taken to sweep out and dilute these gases, as they are evolved, with an inert gas such as $N_2$.

Cell Specifics

The counter electrode employed with the activated nickel anode may consist of any otherwise suitable cathode material which will not provide ions to the electrolyte in an amount capable of deleteriously affecting the formation or functioning of the activated nickel layer on the anode to an intolerable extent.

The efficiency of the $—CH_2OH$ oxidation is generally not critically dependent on such parameters as cell shape, choice of electrode configuration or the presence or absence of a dividing membrane between the electrodes, etc.

In accordance with standard practice, the effective surface areas of those portions of the anode and cathode actively involved in the reaction should be comparable. Also, in order to maintain uniform anode/cathode spacing, the shapes of the two electrodes should conform to each other. However, within the latter constraints, either electrode may be formed from screening, plates, corrugated or expanded metal sheeting, adequately supported membranes or foils, porous frits, metal wools or felts, or constrained, shaped, particle masses.

The cell used may be either divided or undivided but stirring appears to be essential. Preferably, the cell is undivided and is operated in a flowthrough mode; i.e., the reaction mixture ("electrolyte") is circulated, from an external reservoir or sump, between or around the electrodes and back to the sump, to ensure better mixing and higher flow rates across the electrode surfaces and to facilitate removal of the gases evolved at the electrodes.

Reaction Medium/Electrolyte

The reaction medium/electrolyte must include water and a base, i.e., a hydroxide ion source material. Since the substrate to be oxidized will have only limited solubility in water, the medium usually will also include an organic co-solvent for the substrate. The preferred solvent is t-butanol but other water-soluble, not readily oxidized solvents for the substrate may be employed. If a small amount of a surfactant is employed, even solvents which are considered insoluble in water may be useful.

Suitable bases include metal hydroxides—among which KOH is preferred as being readily available, cheap and more soluble than NaOH in organic solvents—and quaternary ammonium hydroxides, which are also more soluble in organics.

The relative amounts of the water, base, co-solvent and substrate are not critical, except that the amount of base should be sufficient to maintain a pH of at least 7.1, but not so high that undesired hydrolysis reactions (such as hydrolysis of ether linkages or halo-substituents, for example) become a problem. As a general rule, base strengths equivalent to KOH concentrations of from about 0.08M to about 1M will result in good electrolyte conductivity and electrode activity. With hydrolizeable substrates, base concentrations in the lower portion (up to about 0.5M) of the latter range are highly preferred.

In order to attain a practically useful initial substrate concentration (about 2–10 wt. %) in the reaction mixture, it will generally be necessary to use a substantial proportion of the co-solvent, particularly when the substrate has a nil or minimal solubility in water. However, the more soluble the co-solvent is in water, the more it will tend to reduce the amount of base that will dissolve in the mixture. Accordingly, the most suitable water to co-solvent ratio will depend on the base, substrate and co-solvent solubilities in water at the reaction temperature selected. However, as a guide, good results have been achieved at water to solvent (t-butanol) ratios of 1:2 for aryloxycarbinols, 1:1 for heteroaryloxycarbinols and up to 4:3 for norbonene dimethanol.

Reaction Parameters

The temperature of the reaction mixture can range from just above the slushing or freezing temperature to just below the initial boiling poing at the pressure at which the oxidation is carried out. Desirably, the temperature is within the range of from about 20° to about 60° C. Within the latter range, temperatures greater than 30° C. will generally tend to result in a higher current efficiency. However, it is preferred to operate below 40° C., in order to minimize undesired hydrolytic side reactions.

To summarize the following more specific discussion of parameters other than temperature, it has been found that the less hydrophobic substrate alcohols are oxidized faster (as evidenced by higher current densities, "CD") and with better current utilization (current efficiency, "CE"). As reported in the literature for the oxidation of other types of alcohols at the nickel peroxide anode, increases in base strength, degree of mixing and temperature are conducive to higher CD's. Anode voltages should be kept below the potential at which the electrolysis of water (oxidation of $OH^-$) occurs to a substantial extent.

Current Efficiency (CE)

The current efficiency is a function of several controllable and noncontrollable factors. Temperature, electrolyte choice and concentration, pH, current density and mixing (mass transfer) are some of the adjustable factors. The noncontrollable factors include unknown metallic and halide impurities, substrate polarity and mobility, activation energies toward nickel peroxide oxidation and the propensity of the alcohol to undergo undesirable side reactions. These (and other) parameters must be optimized on a case by case basis for each alcoholic substrate.

Current Density (CD)

In most cases, higher current efficiencies can be obtained by running the reaction at a lower current density. The more hydrophobic alcohols are best oxidized in the range of 1–10 $mA/cm^2$, whereas less hydrophobic alcohols can be oxidized in the range of 10–30 $mA/cm^2$ with fair to good CE. As the reaction presumably has an EC (electrochemical-chemical) mechanism, a lot depends on the rate of peroxide oxidation and product diffusion away from the electrode surface. The limiting current (LC) is a good measure of how far these reactions can be pushed. The process of the present invention is believed to be operable within the range of from about 0.01 to about 50 $mA/cm^2$ but ordinarily the range of from about 2–20 $mA/cm^2$ will be the most practical.

Electrolyte and Concentration

In most cases KOH has been used, rather than NaOH, due to its higher solubility in organic materials. The electrolyte concentration (usually 0.1–1.0M) is a function of substrate concentration. The cell voltage will increase as the electrolyte is used up neutralizing acid products, unless base is added as the reaction proceeds.

The higher base ($[OH^-]$) concentrations usually give higher conversions to acid products, except when the substrates are unstable to base or would precipitate from the reaction medium if the salt concentration were to become too high.

Cell Voltage

The oxidations preferably are done at constant current, but can be run at constant potential. The anodic voltage (vs. SCE) can fluctuate between +0.5 up to about +1.0 volts, but above this potential water electrolysis will reduce current efficiency. The overall cell voltage starts below 2 volts and may climb as high as 2.8 volts by the end of the run. The major factor controlling the final cell voltage is the base current-voltage obtained in the absence of substrate, negating the effect of any passivation due to polymer formation at the surface of the electrode. Relatively high current densities can be obtained in the range of +0.65 to +0.85 V vs. SCE for most activated systems.

Procedure

The preferred procedure for carrying out the subject oxidations is to assemble the cell (anode, cathode, reference electrode, container, (divider, if used) stirrer bar and/or flow inlet/outlet fittings, etc., to charge to the cell the basic activating mixture, to activate the anode, rinse the electrodes and cell interior surfaces with distilled water, to charge the substrate/medium/electrolyte mixture or solution and to proceed with the oxidation.

The gases evolved at the electrodes preferably are removed by continuously withdrawing a stream of the reaction mixture (as by means of a circulating pump), injecting a stripping and diluting gas ($N_2$) into the stream, passing the stream through a packed column to effect intimate contact of the $N_2$ and the liquid phase, allowing the phases to disengage in a heated (25°–30° C.) sump or reservoir, allowing the gases to discharge through a knock-down condenser and circulating the degassed liquid phase back to the cell.

The oxidation is allowed to continue until a predetermined criterion of a satisfactory degree of conversion of the substrate is satisfied and then terminated. The resultant reaction mixture is worked up for the oxidation product(s), typically by acidifying, extracting with $CH_2Cl_2$ and drying and stripping the extract. Samples of the resulting residues are conveniently analyzed by derivatization with N,O-bis(trimethylsilyl)acetamide and Gas Liquid Chromatographic comparison to derivatized standards. Resort may also be had to IR (Infrared Spectrographic) and NMR (Nuclear Magnetic Resonance) analyses.

EXAMPLES

The following examples are for purposes of illustration and are not to be construed as limiting the present invention in a manner inconsistent with the claims in this patent.

Two types of cells, both undivided, were employed. The first type, a "beaker cell", consisted of a 250 ml electrolytic ("tall") pyrex beaker, a TEFLON-coated stirring magnet, a Monel or expanded nickel screen anode, a counter electrode as specified below and an Ag/AgCl reference electrode fitted with a Luggin tube.

It was placed on a combination hot plate/magnetic stirrer.

The second type was a flow-through or "flow" cell of the well-known type sold by ECO Instruments, connected to a TEFLON piston pump (ECO Instruments; Model 920) incorporated in a circulation and degassing system further described below.

The flow cell, as received, was a "sandwich" held together by four bolt and wing nut sets and consisting of: two $\frac{1}{4}'' \times 4'' \times 9''$, flat, rectangular, 316 stainless steel outer plates (A and B), plate A being provided with inlet/outlet fittings and a reference electrode; a spacing gasket and an electrode securing gasket, each having the shape of a rectangular letter O and consisting of neoprene. In use, the cell included a rectangular anode which had a thickness on the order of 1 to 2 mm and was disposed between the securing gasket and the plate B. On the other side of the latter gasket was disposed a rectangular piece of polyethylene netting (as a flow interupter to enhance mixing). The spacer gasket was disposed between the netting and plate A. Not counting the anode face pressed against plate B or the portions of the opposite face covered by the securing gasket and netting, the active surface area of the anode was about 40 $cm^2$. The spacing gasket was disposed between the netting and plate A—which served as the cathode and electron distributor. Plate B functioned as the anodic electron collector. Electrical shorting through the bolts and wing nuts was prevented by appropriate insulative gasketing.

The circulating and degassing system comprised a 3-necked, round-bottomed flask, immersed in a thermostatically controlled heating bath placed on a combination heater/stirrer, and containing a small stirring magnet. The flask was fitted with (1) a connection to the intake of the circulating pump, (2) a packed column connected to the cell outlet and to an $N_2$ injection valve, and (3) a water-cooled knock-back condenser. The pump outlet was connected to the cell inlet. The circulation rate range from 200 to 250 ml/minute, depending on the viscosity of the cell effluent.

Power was supplied to either cell by a PAR Model 371, operated in the galvanostatic mode. The reference electrode used to monitor the electrode potentials was either an SCE (Corning) for the beaker or an AgCl-treated silver wire set in a 0.2M KCl solution bridged to the cell through a small porous ceramic frit for the flow cell. A Fluke Model 8022B multimeter was used to monitor the voltage difference across the cell.

Analytical Equipment and Procedures

Gas Liquid Chromatography (glc) was carried out with a Hewlett-Packard 5710A glc. The column used was a 6' glass column (2 mm id) packed with SP2100 (10%) on Spelco-support employing helium as the carrier gas. The oven was programmed from 150° C. (2 min) to 220° C. at 8° C./minute increase. Components were observed using a TC detector unit attached to a 3380A-HP integrator. Samples were prepared by extracting the acidified reaction mixture (~0.5 ml) into $CH_2Cl_2$, drying over $MgSO_4$, solvent stripping, then derivatizing with N,O-bis(trimethylsilyl)acetamide (BSA). Unless otherwise stated, area percents are uncorrected.

Infrared analysis was done on a Perkin Elmer 283 IR spectrometer. Samples were compressed into KBr pellets or run as thin films using NaCl plates. The 1601 $cm^{-1}$ peak of polystyrene was used to calibrate the chart paper.

Proton Nuclear Magnetic Resonance (NMR) spectra were taken using an IBM NR/80 NMR operating in FT mode at 80 MHz employing deutero-solvents as the internal lock signal and tetramethylsilane (TMS) at 0.0 ppm as the reference.

Melting points were taken using a Laboratory Devices Mel-Temp and values reported are uncorrected.

EXAMPLE 1

3,5,6-Trichloro-2-(2-hydroxyethoxy)pryidine, i.e., "3,5,6-trichloro-2-pyridinyloxyethanol", was oxidized in the flow system described above. A porous, sintered nickel plaque made by Gould, Inc. was used as the anode and the cathode was the stainless steel cell cover plate "A". The anode was activated in two steps. In the first step, the solution circulated through the cell was 0.1N $NiSO_4$ and 0.1N NaOAc in water containing 0.01 gram KOH per 100 cc, and a current of about 1 ampere was passed through the cell for 60 seconds, with polarities being reversed at a frequency of about 0.5–1.0 cycles per second. In the second step, the anode was "charged" (oxidized) in 2.5N aq. NaOH for one hour, the current initially being about 0.25 amps. The system was rinsed with deionized water and then charged with 150 ml of a 0.2M KOH solution in 2:1 t-butanol/water in which 4 grams of the substrate had been dissolved (0.11 molar substrate solution).

The solution was circulated at a rate of about 150–200 ml/minute for 31 hours while maintaining the cell current at 0.1 amperes, and then worked up as described above. The reaction product was found (by glc analysis), to consist of 86% of the desired 3,5,6-trichloro-2-pyridinyloxy acetic acid, 12% unreacted substrate and about 2% of hydrolyzed material.

At a nominal anode surface of 40 $cm^2$, the nominal current density in the foregoing run was $100/40 = 2.5$ $ma/cm^2$.

EXAMPLE 2

Oxidations of 0.1M solutions of 3,5,6-trichloro-2-pyridinyl ethanol, in 0.2M solutions of KOH in 1:1 t-butanol/$H_2O$, were carried out at ~27° C. in the flow cell at the nickel plaque anode and at a "membrane anode" made by calendering around a 316 stainless steel screen a mixture of 325 mesh nickel powder (13.7 wt. %), 325 mesh graphite (9.2%), TEFLON No. 6 (2.4%), sized NaCl (48.7%) and TRITON* X-100 surfactant (25.9%) and leaching out the salt and surfactant with water. Each anode was activated by applying an alternating current ±0.5 amperes, at 0.5 cycles per second) for several minutes in a 0.1M $NiSO_4$/0.1M NaOAc/0.005M KOH solution, followed by charging at +0.5 to +0.65 volts anode potential in 0.2M aqueous KOH until (~30–60 minutes) a significant drop in current density occurred. The latter, two-step, activation procedure was then repeated. The oxidation was then carried out and the reaction mixture worked up and analyzed, essentially as in Example 1. In both runs, the current density was held at 5 $ma/cm^2$.

(*Registered trademark of Rohm & Haas Co.)

The current efficiency (utilization of current to produce the desired acid) was 56% for the plaque anode and 70% for the membrane anode.

EXAMPLE 3

Two halo-substituted phenoxyethanols and two halo-substituted 2-pyridinyloxyethanols were (separately) oxidized in the flow cell at nickel powder/TEFLON membrane electrodes of the type and activated as described in the preceding example (2). In each run, the current density was held at 5 ma/cm$^2$. The equivalents of electrons theoretically required for each oxidation was 4 and each run was continued—essentially as in Example 2—until the actual equivalents of electrons passed through the cell was as given in Table I following. Each reaction mixture was initially about 0.1 molar in the substrate and 0.2 molar in KOH. The electrolyte composition is given below the formula of each of the four substrates, as follows:

2-methyl-4-chlorophenoxyethanol

1

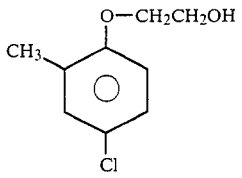

(In 2:1 t-butanol/water)

2,3-dichlorophenoxyethanol

2

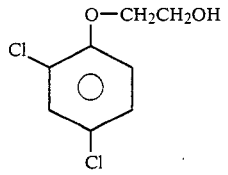

(In 2:1 t-butanol/water)

4-amino-3,5-dichloro-6-fluoro-2-pyridinyloxy ethanol

3

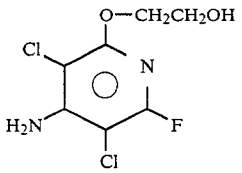

(In 1:1 t-butanol/water)

3,5,6-trichloro-2-pyridinyloxyethanol

4

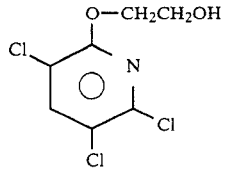

(In 1:1 t-butanol/water)

TABLE I

| Substrate | Reaction Temp. | Reaction Time | e.e.[1] | C.E.[2] | Yield[3] | Acid Product Recovered Composition[4] Desired Hyd. Acid | Prod. |
|---|---|---|---|---|---|---|---|
| 1 | 30° C. | 7 hrs | 6.6 | 50% | 97% | 99% | 1% |
| 2 | 28° C. | 8 hrs | 6.2 | 48% | 95% | 98% | 2% |
| 3 | 30° C. | 8 hrs | 5.8 | 56% | 92% | 99% | 1% |
| 4 | 27° C. | 6 hrs | 4.4 | 70% | 97% | 94% | 6% |

Notes:
[1]Electron equivalents passed.
[2]Current utilization in production of desired acid.
[3]Yield of crude acid based on substrate conversion.
[4]GLC Area %'s.

Each of the product acids is a highly active herbicide; the acid derived from substrate 4, for example, is the commercial herbicide GARLON (registered trademark of The Dow Chemical Company).

EXAMPLE 4

The following isomeric phenoxyethanols were oxidized, under identical conditions, at an activated nickel plaque anode, by the method of the present invention.

5

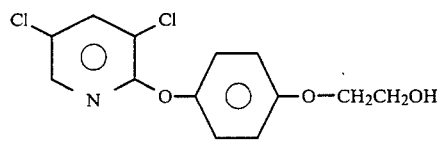

2-(4-(3,5-dichloro-2-pyridinyloxy)phenoxy)ethanol

6

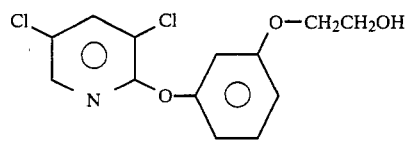

2-(3-(3,5-dichloro-2-pyridinyloxy)phenoxy)ethanol

After passage of 6 electron equivalents at a current density of 5 ma/cm$^2$, only 67% of substrate 5 had been converted to the corresponding phenoxyacetic acid, whereas the figure was 94% for substrate 6.

EXAMPLE 5

In essentially the manner of Example 4, 3-chloro-5-trifluoromethyl-2-pyridinyloxyethanol was oxidized in a first run at a nickel powder/TEFLON membrane anode in the flow cell. In a second run, the same substrate was oxidized in the beaker cell at a Monel screen anode. The alkyl sulfonate surfactant was used in both runs. The results are given in Table II.

TABLE II

| Run No. | Sub. Conc. | Elect. & Conc. | Solvent $H_2O$—t-Butanol | React Temp. (°C.) | CD Ma/Cm$^2$ | CE Acid |
|---|---|---|---|---|---|---|
| 1 | 0.1 M | KOH 0.25 M | 1:1 | 23° | 10 | 59% |
| 2 | 0.1 M | KOH 0.20 M | 1:2 | 25° | 1 | 54% |

EXAMPLE 6

Each of two dicycloaliphatic dialcohols was separately oxidized, in both a beaker-type cell and the flow cell, utilizing several different anode supports, substrate concentrations, KOH concentrations and t-butanol to water ratios.

The beaker cell ("B") and flow cell ("F") used are described earlier herein. The activation procedure used consisted of two repetitions of the two-step method described above. The details of the runs with each substrate (norbornene dimethanol and dicyclopentadiene dimethanol) are given in Table III following.

TABLE III

OXIDATION OF DIALCOHOLS TO DIACIDS

SUBSTRATE: NORBORNANE DIEMETHANOL

| Sub. Conc. | Elect. & Conc. | Solvent $H_2O$/t-Butanol | React. Temp. (C.) | Anode Support Material | Cell | CD Ma/Cm | CE Diacid |
|---|---|---|---|---|---|---|---|
| 0.08 M | 0.2 M KOH | 1:2 + Sr[2] | 40° | MS[3] | B | 10 | 89% |
| 55 | 1.2 M KOH | 4:3 + Sr | 38° | EN[4] | B | 6.6 | 95% |
| 0.19 M | 0.5 M KOH | 1:1 + Sr | 40–45° | NP[5] | F | 17 | 80% |
| 0.2 M | 0.1 M KOH | 1:2 | RT | MS | B | 1 | 20% |
| 0.3 M | 0.1 M KOH | " | 40° | " | " | 2 | 60% |
| 0.2 M | 0.5 M KOH | " | 32° | EN | " | 2 | 87% |
| 0.3 M | 0.6 M KOH | 1:1 + Sr | 40–45° | " | " | 4 | 87% |
| 0.15 M | 0.25 M KOH | 1:2 | 24° | MP[6] | F | 2 | 58% |
| 0.12 M | 0.26 M KOH | 1:2 | 30° | NP | " | 2 | 70% |
| 0.12 M | 0.26 M KOH | 1:2 | 30° | NP | " | 2 | 70% |
| 0.26 M | 0.39 M KOH | 1:1 | 30° | " | " | 5 | 68% |
| 0.52 M | 1.0 M NaOH | 1:1 + Sr | 40° | " | " | 11 | 77% |

Notes:
[1]Substrate Concentration.
[2]Alkyl Surfonate-based surfactant; few drops.
[3]Monel Screen.
[4]Expanded Nickel Sheet.
[5]Nickel Plaque.
[6]Monel Plaque.

What is claimed is:

1. The method of oxidizing a $—CH_2OH$ group in a hydrophobe to a —CHO or —COOH group which comprises electrochemically oxidizing said hydrophobe, in a basic aqueous medium, at an oxidized nickel anode, said hydrophobe being selected from the group consisting of:

(A) glycol ethers of the formula

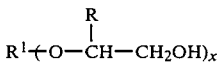

(I)

wherein x=1 or 2,

R=H or a $C_1$–$C_{40}$ hydrocarbyl or heterohydrocarbyl radical, optionally substituted with one or more non-interfering radicals, $R^1$ is a mono- or divalent radical of one of the following formulas a, b or c

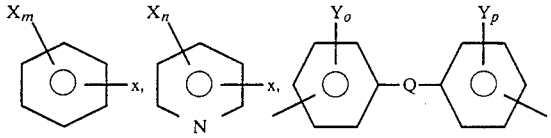

a. b. c.

wherein x is 1 or 2,

X is halo, haloalkyl, alkyl, alkenyl, amino, nitro, alkoxy or haloalkoxy, independently in each occurrence, m is 0 to 5 and n, o and p are each, independently, 0–4, Q is a valence bond, a $C_1$–$C_4$ alkylene or alkenylene group, $>C(CF_3)_2$, —CO—, —S—, $—SO_2—$ or —O—; and Y is halo, alkyl, alkenyl alkoxy, haloalkoxy or nitro, independently in each occurrence, with the provisos that:

the maximum number of nitro groups per ring is 3 in formula a and 2 in formulas b and c;

the maximum number of alkyl, alkenyl, alkoxy and/or haloalkoxy groups per ring is 2 in formulas a and b and 1 in formula c;

the maximum number of amino groups per ring, in formulas a and b, is 2; and the maximum number of haloalkyl groups per ring, in formulas a and b, is 2;

(B) phenoxyaryl- or phenoxyheteroaryloxyethanols of the formula

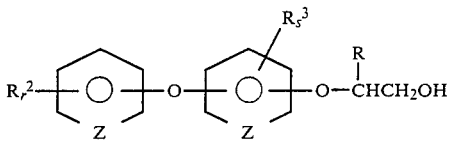

(II)

wherein r=0, 1, 2, 3 or 4 and s=0, 1, 2 or 3,

Z=CH or N, in one occurrence and N in the other, $R^2$, independently in each occurrence, is alkyl, alkenyl, haloalkyl, halo, nitro, amino, $C_2$–$C_{42}$ alkoxy or haloalkoxy or is $—OCHRCH_2OH$, R is as defined with regard to formula I; and $R^3$, independently in each occurrence, is alkyl, alkenyl, haloalkyl, halo, nitro, amino, alkoxy or haloalkoxy;

with the provisos that:

not more than one $R^2$ or $R^3$ group per ring is nitro, not more than two $R^2$ or $R^3$ groups per ring are haloalkyl, not more than one $R^2$ or $R^3$ group per ring is amino,
not more than one $R^2$ or $R^3$ group per ring is alkoxy or haloalkoxy,
not more than one $R^2$ is O—CHR$CH_2$OH,
not more than one $R^2$ or $R^3$ group per ring is alkyl or alkenyl; and (C) polycycloaliphatics ring-substituted by one or two —$CH_2$OH groups and, optionally, with one or more non-interfering radicals.

2. The process of claim 1 wherein R is H or $CH_3$.

3. The process of claim 2 wherein said hydrophobe is deriveable from the adduction of 1 molecule of ethylene- or propylene-oxide with a monohydric phenol or pyridinol substituted with two to three chloro- and/or fluoro-radicals and, optionally, an amino group.

4. The process of claim 1 wherein said hydrophobe is deriveable from the adduction of two molecules of a $C_2$–$C_{42}$, 1,2-alkylene oxide with a bisphenol of the formula

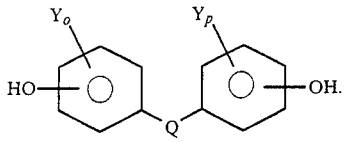

5. The process of claim 3 wherein said hydrophobe is selected from the group consisting of 2-methyl-4-chlorophenoxyethanol, 2,4-dichlorophenoxyethanol, 4-amino-3,5-dichloro-6-fluoro-pyridinyloxyethanol and 3,5,6-trichloro-2-pyridinyloxyethanol.

6. The process of claim 4 wherein said alkylene oxide is ethylene- or propylene-oxide.

7. The process of claim 1 wherein said hydrophobe is deriveable from the adduction of 1 or 2 molecules of a $C_2$–$C_{42}$, 1,2-alkylene oxide with a compound of the formula

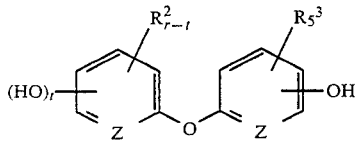

(III)

wherein t is 0 or 1, Z, r, s and $R^3$ are as defined above for formula II and $R^2$ is also as defined above except that it may not be —O—CHR—$CH_2$OH.

8. The process of claim 7 in which said alkylene oxide is ethylene- or propylene-oxide.

9. The process of claim 2 in which said hydrophobe is deriveable by the adduction of a molecule of ethylene- or propylene-oxide with a pyridinyloxyphenol of the formula

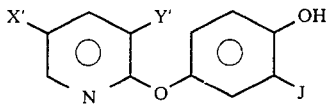

wherein X' is $CF_3$ or halo, Y' is halo and J is H or halo.

10. The process of claim 9 in which the oxide is propylene oxide.

11. The process of claim 10 in which said pyridinyloxyphenol is selected from the group in which X', Y' and J are as follows:

| X' | Y' | J |
|---|---|---|
| $CF_3$ | Cl | H |
| $CF_3$ | Cl | Cl |
| $CF_3$ | F | H |
| $CF_3$ | F | Cl |
| F | Cl | H |
| F | Cl | Cl |
| F | F | H or Cl |
| Cl | Cl | H |
| Cl | Cl | Cl |
| Br | F | H |
| Br | F | Cl |
| Br | Cl | H |
| Br | Cl | Cl. |

12. The process of claim 11 in which said hydrophobe is 2-(4-(3,5-dichloro-2-pyridinyloxy)phenoxy)ethanol.

13. The process of claim 1 in which said hydrophobe is a polycycloaliphatic, ring-substituted only by one or two —$CH_2$OH groups.

14. The process of claim 13 in which said hydrophobe is norbornane dimethanol or dicyclopentadiene dimethanol.

* * * * *

UNITED STATES PATENT AND TRADEMARK OFFICE

CERTIFICATE OF CORRECTION

PATENT NO. : 4,496,440

DATED : January 29, 1985

INVENTOR(S) : K. D. Campbell; A. H. Gulbenkian; F. Y. Edamura; D. Kyriacou.

It is certified that error appears in the above—identified patent and that said Letters Patent is hereby corrected as shown below:

Column 5: line 36, "location" should be plural -- locations --;

line 65, delete "of" after "and";

Column 9, line 12, delete "poing" and insert -- point --;

Column 12, line 13, "pyridine" has been misspelled;

line 55, before "±0.5" there should be an opening parenthesis: -- (±0.5 --;

Column 13, line 33, delete "2,3-dichlorophenoxyethanol" and insert -- 2,4-dichlorophenoxyethanol --;

UNITED STATES PATENT AND TRADEMARK OFFICE

CERTIFICATE OF CORRECTION

PATENT NO. : 4,496,440

DATED : January 29, 1985

INVENTOR(S) : K. D. Campbell; A. H. Gulbenkian; F. Y. Edamura; D. Kyriacou.

It is certified that error appears in the above—identified patent and that said Letters Patent is hereby corrected as shown below:

Column 15, Table III:

last word in second sentence of Title should read -- DIMETHANOL --;

first column, second Sub. Conc. delete "55" and insert -- 0.55M --;

third line from bottom is a repeat of the one immediately above it; should be deleted;

Notes: #2, second word should be -- Sulfonate-based --;
#6, delete "Plaque" and insert -- Plate --.

Signed and Sealed this

*Twentieth* Day of *August 1985*

[SEAL]

*Attest:*

DONALD J. QUIGG

*Attesting Officer* *Acting Commissioner of Patents and Trademarks*